US010052513B2

(12) United States Patent
Schrag

(10) Patent No.: US 10,052,513 B2
(45) Date of Patent: Aug. 21, 2018

(54) APPARATUS FOR TRAINING MUSCLES

(71) Applicant: BLBW AG, Schwarzsee (CH)

(72) Inventor: Michael Schrag, Schwarzsee (CH)

(73) Assignee: BLBW AG, Schwarzsee (CH)

( * ) Notice: Subject to any disclaimer, the term of this patent is extended or adjusted under 35 U.S.C. 154(b) by 0 days.

(21) Appl. No.: 15/534,555

(22) PCT Filed: Dec. 12, 2014

(86) PCT No.: PCT/EP2014/077606
§ 371 (c)(1),
(2) Date: Jun. 9, 2017

(87) PCT Pub. No.: WO2016/091330
PCT Pub. Date: Jun. 16, 2016

(65) Prior Publication Data

US 2017/0340914 A1 Nov. 30, 2017

(51) Int. Cl.
*A63B 21/008* (2006.01)
*A63B 21/00* (2006.01)
(Continued)

(52) U.S. Cl.
CPC .... *A63B 21/0083* (2013.01); *A63B 21/00072* (2013.01); *A63B 21/0087* (2013.01);
(Continued)

(58) Field of Classification Search
CPC ..... A63B 21/0083; A63B 21/4047; A63B 21/4035; A63B 21/023; A63B 21/0087;
(Continued)

(56) References Cited

U.S. PATENT DOCUMENTS 3,858,873 A * 1/1975 Jones ..... A63B 21/0615 482/137
3,912,261 A * 10/1975 Lambert, Sr. ..... A63B 21/06 482/100

(Continued)

OTHER PUBLICATIONS

International Search Report and Written Opinion issued in corresponding international application No. PCT/EP2014/077606 dated Aug. 6, 2015, 10 pages.

*Primary Examiner* — Garrett Atkinson
(74) *Attorney, Agent, or Firm* — Pearne & Gordon LLP

(57) ABSTRACT

An apparatus (1) for exercising muscles comprises a power arm (2), which is pivotable about a pivot shaft (5), which is disposed on a holding element (6). The first articulation point (7) at which a compression spring element (9) is linked to the power arm (2) is adjustable along the power arm (2). To achieve this, one end region (8) of the compression spring element (9) is provided with a first joint surface (14), and a series of second joint surfaces (16), which are designed complementary to the first joint surface (14), is disposed across an adjustment zone (10) along the power arm (2). The first joint surface (14) is operatively connectible to one of the second joint surfaces (16), and the power arm (2) is pressed via a further spring element (18) toward the one end region (8) of the compression spring element (9) such that the two operatively connected joint surfaces are kept in contact with each other. Resulting thereby is a simple possibility of adjustment of the force to be applied to the power arm.

10 Claims, 5 Drawing Sheets

(51) Int. Cl.

| | |
|---|---|
| ***A63B 21/02*** | (2006.01) |
| ***A63B 21/055*** | (2006.01) |
| *A63B 21/04* | (2006.01) |
| *A63B 23/12* | (2006.01) |

(52) U.S. Cl.
CPC ..... *A63B 21/023* (2013.01); *A63B 21/0552* (2013.01); *A63B 21/4035* (2015.10); *A63B 21/4047* (2015.10); *A63B 21/0421* (2013.01); *A63B 23/1218* (2013.01)

(58) Field of Classification Search
CPC ..... A63B 21/00072; A63B 21/0552; A63B 23/1218; A63B 21/0421
See application file for complete search history.

(56) References Cited

U.S. PATENT DOCUMENTS

| | | | | |
|---|---|---|---|---|
| 4,275,882 | A | 6/1981 | Grosser | |
| 4,426,077 | A | 1/1984 | Becker | |
| 4,796,881 | A | 1/1989 | Watterson | |
| 4,811,944 | A * | 3/1989 | Hoff | A63B 23/129 482/139 |
| 5,336,142 | A * | 8/1994 | Dalebout | A63B 21/00072 482/111 |
| 5,356,360 | A * | 10/1994 | Johns | A63B 21/155 482/100 |
| 6,036,622 | A * | 3/2000 | Gordon | A63B 21/154 482/51 |
| 7,645,215 | B2 * | 1/2010 | Gordon | A63B 21/155 482/51 |
| 7,833,134 | B2 * | 11/2010 | Gordon | A63B 22/0017 482/51 |
| 8,517,899 | B2 * | 8/2013 | Zhou | A63B 69/182 482/138 |
| 9,358,420 | B2 * | 6/2016 | Funk | A63B 21/159 |
| 9,713,738 | B2 * | 7/2017 | Schrag | A63B 21/0087 |
| 2007/0037667 | A1 * | 2/2007 | Gordon | A63B 21/155 482/51 |
| 2007/0129222 | A1 | 6/2007 | Kolomeir | |
| 2008/0132391 | A1 * | 6/2008 | Edeker | A63B 21/00 482/121 |
| 2010/0144496 | A1 * | 6/2010 | Schmidt | A63B 21/012 482/70 |
| 2010/0152001 | A1 * | 6/2010 | Gordon | A63B 21/155 482/53 |
| 2014/0296042 | A1 | 10/2014 | Snyder | |
| 2016/0016033 | A1 * | 1/2016 | Schrag | A63B 21/0087 482/112 |

* cited by examiner

APPARATUS FOR TRAINING MUSCLES

This invention relates to an apparatus for exercising muscles, comprising a power arm, which is equipable at one end region with actuating elements and which is pivotable by the other end about a pivot shaft which is disposed on a holding element, to which power arm the one end region of a compression spring element is linked at a first articulation point, which first articulation point is adjustable along the power arm, while the other end region of the compression spring element is linked on the holding element at a second articulation point.

Such apparatuses for exercising muscles are known in various designs. Thus, for example, the document U.S. Pat. No. 4,618,140 A shows such an apparatus in which the first articulation point, at which the one end region of the compression spring element is linked to the power arm, is adjustable along the power arm. To achieve this, a series of bores are made on the power arm, the end region of the compression spring element is provided with a fastener which surrounds the power arm. Inserted into this fastener is a shaft which is pressed, via a spring, into the respective bore on the power arm, whereby the end region of the compression spring element is fixed on the power arm. For adjustment, the spring-loaded shaft must be pulled out of the bore. The fastener on the end region of the compression spring element can be shifted along the power arm. In the desired position the shaft is once again pressed into the respective bore, via the spring, and the exercising can continue, whereby the force to be overcome on the power arm is greater or lesser, depending upon the setting.

With this apparatus, the adjustment of the force which the operation of the power arm works against, is complicated. In particular the position of the end region of the compression spring element on the power arm must be precisely set during adjustment so that the shaft is able to penetrate into the bore. In particular there exists the risk that the shaft is not correctly inserted into the bore, so that during movement of the power arm an undesired shifting can take place of the articulation point of the compression spring element along the power arm, which can be unpleasant for the person who is operating the power arm.

The object of the present invention thus consists in providing an apparatus for exercising muscles in which the articulation point of the compression spring element can be adjusted in a simple way along the power arm, and with which it is ensured that the linking of the compression spring element on the power arm takes place correctly. A space-saving and easy-to-operate apparatus for exercising muscles should be created.

This object is achieved according to the invention in that the one end region of the compression spring element is provided with a first joint surface, which has a first curvature, and disposed along the power arm over an adjustment zone is a series of second joint surfaces, which each have a second curvature, which is designed complementary to the first curvature, so that the one end region of the compression spring element with the first joint surface is able to be brought into operative connection to one of the second joint surfaces, and the power arm is pressable, via a further spring element, toward the one end region of the compression spring element, in such a way that the two joint surfaces in operative connection are kept in contact.

By means of this inventive design of the apparatus for exercising muscles, to adjust the force which the operation of the power arm counteracts, the power arm can be lifted, against the active force of the further spring element, from the joint surface of the end region of the compression spring element. The compression spring element can be adjusted. The further spring element pulls the power arm again toward the end region of the compression spring element. The first joint surface of the one end region of the compression spring element comes into engagement with one of the second joint surfaces on the power arm. The adjustment of the force is thereby achieved in the simplest way. The first joint surface will be led in any case into a second joint surface in each case. A faulty manipulation is thereby avoidable. Furthermore the configuration of the individual elements and of the power arm makes possible a compact construction, which above and beyond this offers leeway for an aesthetic design of the apparatus for exercising muscles.

Preferably the curvature of the first joint surface is designed concave and the curvatures of the second joint surfaces are designed convex, whereby an optimal operative connection is achieved.

Preferably the first joint surface and the second joint surfaces are designed cylindrical, and the respective cylinder axes are aligned parallel to the pivot shaft, which results in a simple construction and an optimal functioning of the adjustment device.

Preferably the second joint surfaces are formed by cylindrical shafts, which are disposed in a row and spaced apart from one another over the adjustment zone on the power arm, and the first joint surface are <sic. is> formed in the root of a fork, which is placed at the one end region of the compression spring element. This results in an apparatus simple in structure and in an optimal functioning of the adjustment zone of the apparatus. The first joint surface is thereby held reliably on the second joint surface.

The cylindrical shafts are placed in two crosspieces opposite one another and disposed along the zone of the power arm, which makes possible a simple manufacture of the adjustment zone.

Preferably the compression spring element is a gas pressure spring, which can be inserted in a simple way in the apparatus.

Preferably the further spring element is designed as pull spring, which can be installed in a simple way in the apparatus for exercising muscles. The compression spring element and the pull spring engage in the same end region on the holding element and thus allow a space-saving construction.

Another advantageous embodiment of the invention consists in the pull spring being an elastic band, whose one end region is attachable on the holding element in the area of the second articulation point and whose other end region is detachably attached to the power arm. This results in an optimal functioning. Achieved through the possibility of the release of the elastic band from the power arm can be that the power arm is pivoted away from the compression spring element and can be brought into a stretched position with respect to the holding element, so that during non-use of this apparatus, the apparatus can be put away in a space-saving manner.

Preferably provided on the power arm along the adjustment zone is a scale, whereby, for example, it is ascertainable visually what the force is which the operation of the power arm is working against.

The holding element can be attached to a supporting frame, so that, for example, the alignment of the apparatus and the height adjustment can also be carried out in an optimal way.

An embodiment of the invention will be explained more closely in the following, by way of example, with reference to the attached drawings.

FIG. 7 shows a side view of the apparatus for exercising muscles with power arm pivoted in; and FIG. 8 shows a view from the front of the apparatus for exercising muscles according to FIG. 7 with power arm pivoted in.

Figure 1:
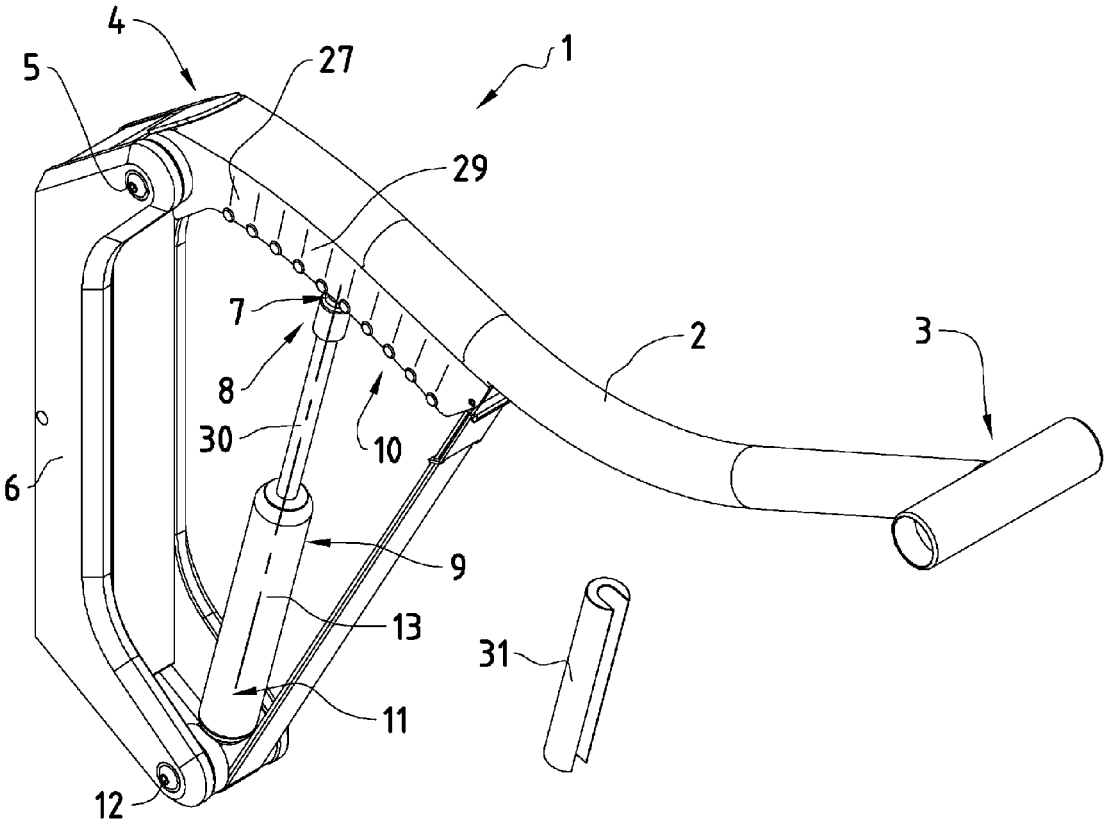
FIG. 1 shows in a three-dimensional representation the apparatus for exercising muscles according to the invention.

As can be seen from FIG. 1, the apparatus 1 for exercising muscles has a power arm 2. The one end region 3 of the power arm 2 is designed in such a way that actuation elements (not shown) can be inserted in a known way, whereby the power arm 2 can be operated in a suitable way by the exercising person. The other end region 4 of the power arm 2 is pivotable about a pivot shaft 5, which is disposed on a holding element 6. At a first articulation point 7, the one end region 8 of a compression spring element 9 is coupled to the power arm 2. This first articulation point 7 and thus the one end region 8 of the compression spring element 9 is adjustable along an adjustment zone 10 on the power arm 2, as will be described later in detail. The other end region 11 of the compression spring element 9 is coupled at a second articulation point 12 on the holding element 6. In the embodiment example shown here, the compression spring element 9 is designed as gas pressure spring 13.

For exercising muscles, the power arm 2 can be pivoted about the pivot shaft 5, whereby the gas pressure spring 13 generates a counter force to the operating force and presses the power arm 2 back into the original position again, which is obtained with the reaching of the completely driven-out gas pressure spring 13.

Figure 2:
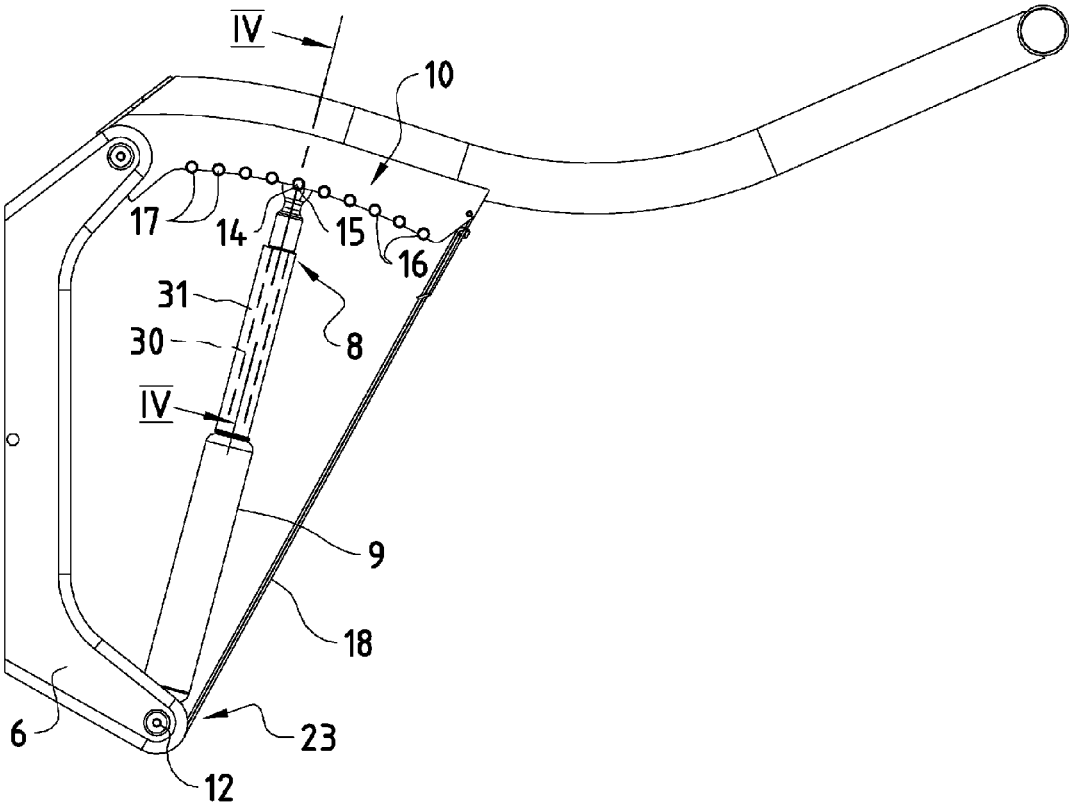
FIG. 2 shows a side view of the apparatus for exercising muscles according to FIG. 1.

As can be seen from FIG. 2, the one end region 8 of the compression spring element 9 has a first joint surface 14 with a first curvature 15, while disposed along the power arm 2 over the adjustment zone 10 is a series of second joint surfaces 16 each with a second curvature 17, which curvatures are designed complementary to the first curvature 15. As will be described later, the one end region 8 of the compression spring element 9 with the first joint surface 14 thereby comes into operative connection with one of the second joint surfaces 16. The first joint surface 14 and the second joint surface 16 are pressed via a further spring element 18 against the one end region 8 of the compression spring element 9, so that both the first joint surface 14 and second joint surface 16, which are in operative connection, are kept in contact with one another.

As can be seen from FIG. 1, a blocking element 31 can be provided having the form of a hollow cylinder which is provided with a longitudinal slot over the entire length. As can be learned from FIG. 2, this blocking element 31 can be placed on the gas pressure spring rod 30 when the gas pressure spring 13 is in the completely driven-out position. In this state the power arm 2 is locked; it cannot be pivoted. This apparatus for exercising muscles can thereby serve for the exercise of chin-ups, for example.

Figure 5:
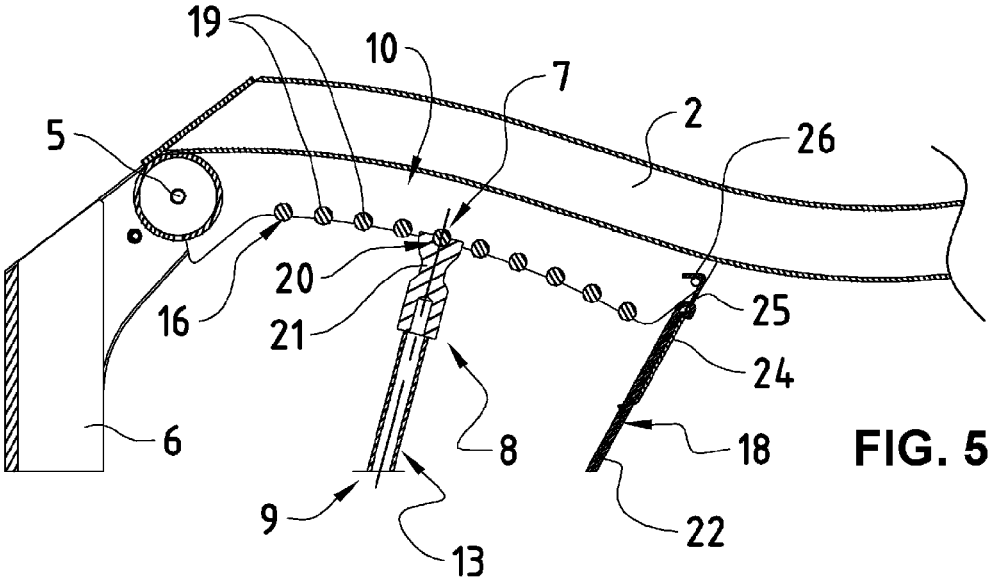
FIG. 5 shows a sectional representation along line V-V according to FIG. 3 through the adjustment zone of the apparatus for exercising muscles.

As can be seen in particular from FIG. 5, the second joint surfaces 16 are formed by cylindrical shafts 19, which are disposed in series and spaced apart from one another over the adjustment zone 10 on the power arm 2.

The first joint surface 14 is formed in the root 20 of a fork 21, which fork 21 is attached at one end region 8 of the compression spring element 9. Through this design the first joint surface 14 has a concave shape, while the second joint surfaces 16 are designed convex. The axes of the cylindrical shafts 19 are aligned parallel to the pivot shaft 5, about which the power arm 2 is pivotable with respect to the holding element 6.

As has already been mentioned, the power arm 2 is pressed via the further spring element 18 toward the compression spring element 9. Thereby achieved is that the first joint surface 14 and the respective second joint surface 16, which are only led into one another, remain in contact with one another. By means of this adjustment zone 10, the articulation point 7 can be adjusted with respect to the pivot shaft 5. When the power arm 2 is in the position in which the compression spring element 9, which is designed as gas pressure spring 13, is in the completely driven-out position, the power arm 2 can be pivoted further against the spring force of the further spring element 18. The fork 21 with the second joint surface 16 moves out of the cylindrical shaft 19 and the first joint surface 14. The one end region 8 of the compression spring element 9 can be moved together with the fork 21 along the series of cylindrical shafts 19 and allows itself, through the pivoting back of the power arm 2, to be moved again into the desired position on the corresponding cylindrical shaft 19, whereby once again the further spring element 18 causes the first joint surface 14 and the newly selected second joint surface 16 of the corresponding cylindrical shaft 19 to remain again in contact. The spacing of the first articulation point 2 <sic. 7> to the pivot shaft 5 can thereby be adjusted in a simple way. The force to be applied to the power arm can thus be accordingly adjusted.

Ensured through the width of the fork 21 and the spacing of the individual cylindrical shafts 19 with respect to one another is that no malfunctions can occur during adjustment. The fork 21 will always be in engagement with a cylindrical shaft 19, whereby safe operation is guaranteed. Even with incorrect clicking into place, the fork 21 of the compression spring element 9 under load automatically jumps onto the nearest cylindrical shaft 21.

The further spring element 18 is preferably designed as elastic band 22, whose one end region 23 (FIG. 2) can be attached in the region of the second articulation point 12 on the holding element 6, while the other end region 24 can be detachably attached on the power arm 2. For this purpose a hook 25 can be attached on this other end region 24 on the elastic band 22, which hook can be hooked onto a pin 26 provided on the power arm.

Figure 3:
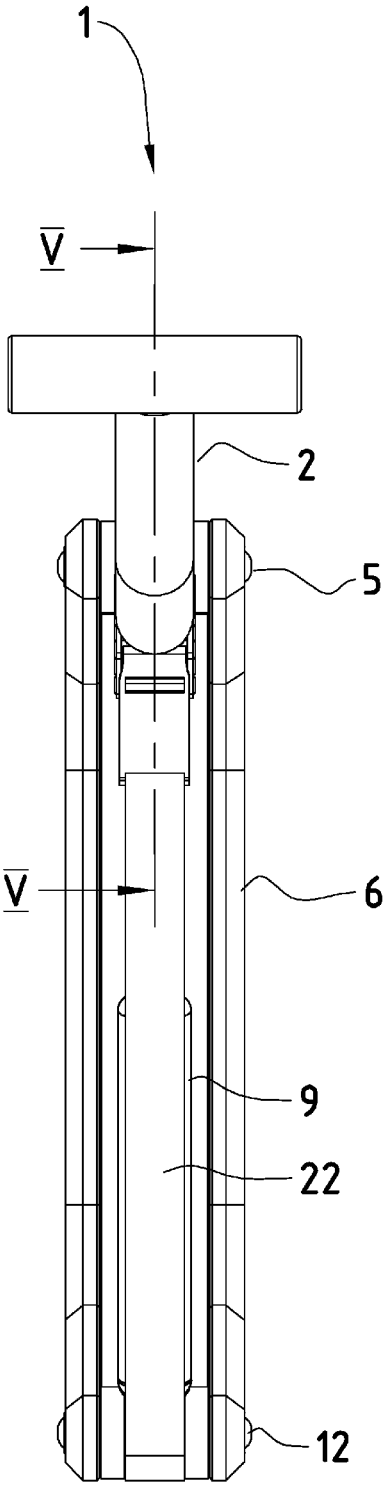
FIG. 3 shows a view from the front of the apparatus for exercising muscles according to FIG. 1.

FIG. 3 shows a view from the front of the apparatus 1 according to the invention. Visible is the power arm 2, which is held in the holding element 6 in a way pivotable about the pivot shaft 5. Likewise visible is the elastic band 22, with which the power arm 2 is pressed against the compression spring element 9, as has been described previously.

Figure 4:
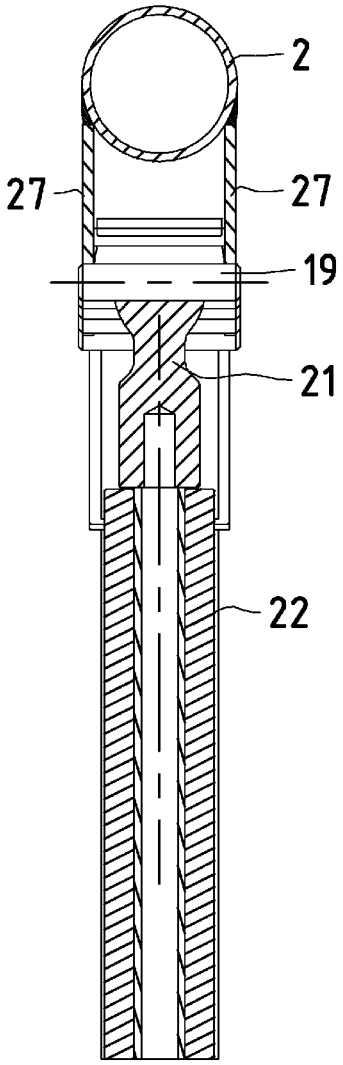
FIG. 4 shows a sectional representation of the apparatus for exercising muscles along line IV-IV according to FIG. 2.

Visible from the sectional representation according to FIG. 4 is how the fork 21 is engaged with a cylindrical shaft 19 in a flexible way. Thereby visible is that the cylindrical shafts 19 are held in two crosspieces 27, which are disposed on the power arm 2.

Figure 6:
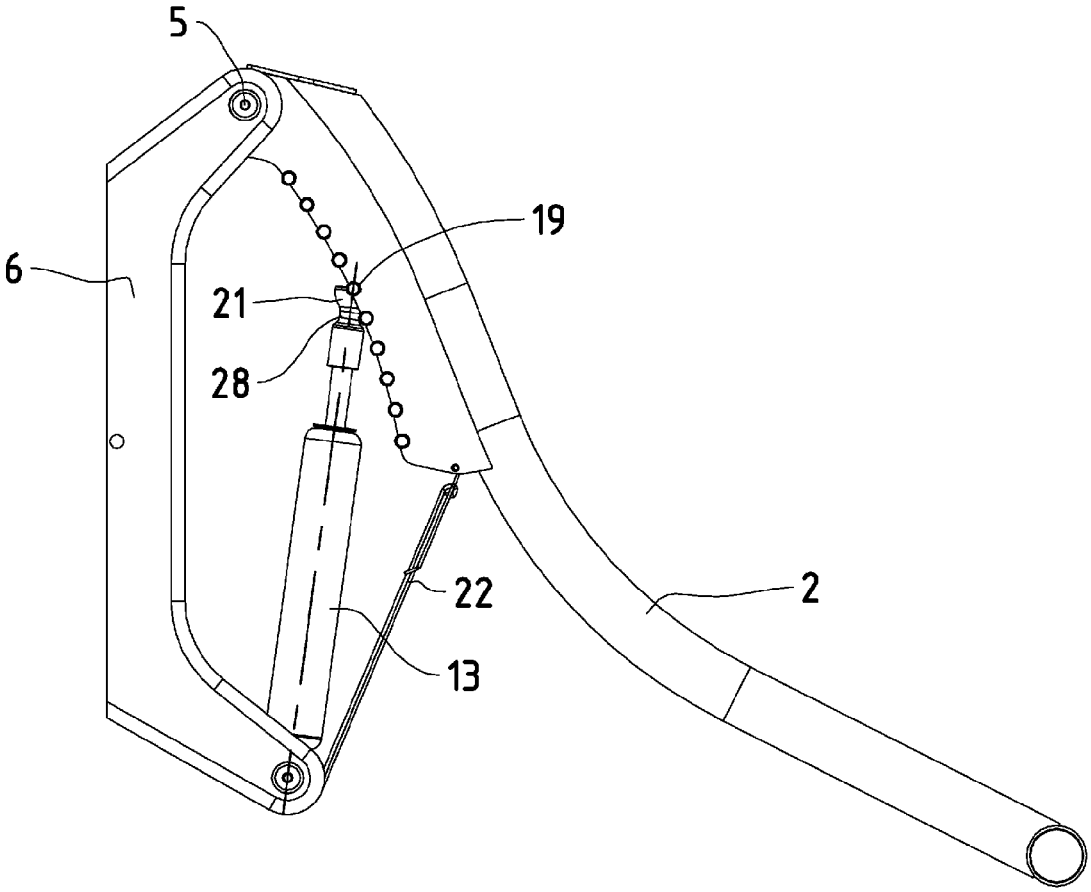
FIG. 6 shows a side view of the apparatus for exercising muscles with power arm pressed downward.

Visible from FIG. 6 is the pressed position of the power arm 2. The gas pressure spring 13 is located in the driven-in state. It can thereby be seen that the fork 21 is supported in an optimal way on the corresponding cylindrical shaft 19. A slipping away of the fork 21 out of the cylindrical shaft 19 can be excluded. The secure operation is ensured. As is apparent from this FIG. 6, it is advantageous if the fork 21 is provided in each case with a recess 28 on the outside, whereby space is made for the cylindrical shaft which is adjacent to the cylindrical shaft 19 with which the fork 21 is engaged.

Figure 7:
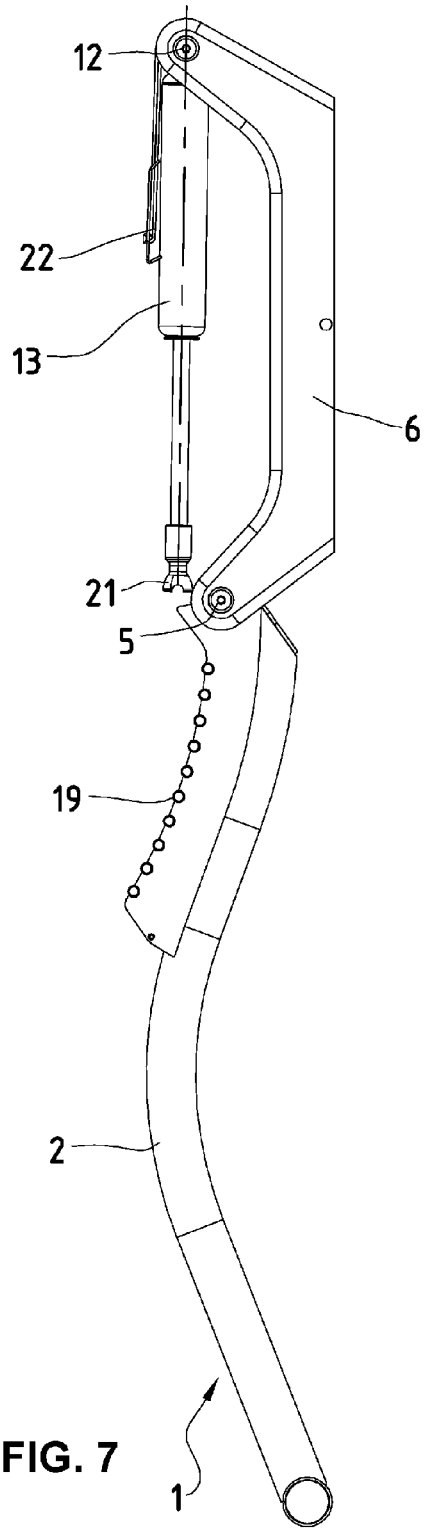
Figure 8:
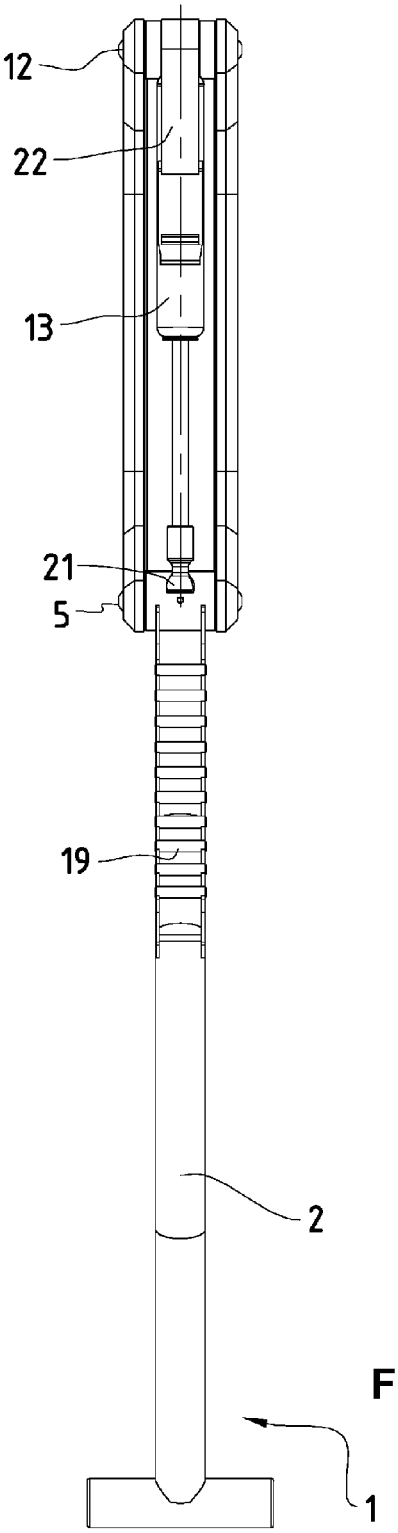

As can be learned from FIGS. 7 and 8, the power arm 2 can be pivoted about the pivot shaft 5 completely away from the gas pressure spring 13. To achieve this, the elastic band 22 is unhooked from the power arm 2. The power arm 2 can then be pivoted, whereby the fork 21 is moved out of the respective cylindrical shaft 19. The power arm 2 can thereby be brought into a parked position. The gas pressure spring 13 is pivoted toward the holding element 6. The apparatus 1 can thereby be brought into a space-saving position. The elastic band 22 is then located in front of the gas pressure spring 13.

The holding element 6 and thus the apparatus 1 for exercising muscles can also be fixed in a known way to a supporting frame (not shown). The holding element 6 and thus the apparatus 1 for exercising muscles can then be adjusted with respect to this supporting frame, for example with respect to the height from the floor or also with respect to an angular position to this supporting frame.

As can also be seen from FIG. 1, a scale 29 can be put on a first crosspiece 27 of the power arm 2, whereby a reproducible adjustment is possible in a simple way, for example of the force to be applied for pivoting of the power arm.

With this inventive solution, with an apparatus for exercising muscles having a power arm able to be actuated, the force to be applied to the power arm can be adjusted in a simple way, so that the force to be applied to the power arm can have differing magnitudes.

The invention claimed is:

1. An apparatus for exercising muscles, comprising a power arm which is equipable at one end region with actuation elements and which is pivotable about a pivot shaft located at another end of said power arm and disposed on a holding element, a compression spring element being linked to said power arm at a first articulation point and to said holding element at a second articulation point, said first articulation point being adjustable along the power arm, wherein a first end region of the compression spring element adjacent to said first articulation point is provided with a first joint surface which has a first curvature, and disposed along the power arm over an adjustment zone is a series of second joint surfaces each having a second curvature designed complementary to the first curvature, so that the first end region of the compression spring element with the first joint surface is able to be brought into operative connection to one of the second joint surfaces, a pull spring pressing the power arm toward the first end region of the compression spring element such that the first joint surface and a selected one of said second joint surfaces in operative connection are kept in contact, the pull spring having a first end attached to the holding element and a second end attached to the power arm at a location different than the first articulation point.

2. The apparatus for exercising muscles according to claim 1, wherein the first curvature of the first joint surface is designed concave and the second curvatures of the second joint surfaces are designed convex.

3. The apparatus for exercising muscles according to claim 1, wherein the first joint surface and the second joint surfaces are designed cylindrical, and the respective cylinder axes are aligned parallel to the pivot shaft.

4. The apparatus for exercising muscles according to claim 3, wherein the second joint surfaces are formed by cylindrical shafts, which are disposed in a row and spaced apart from one another over the adjustment zone on the power arm, and the first joint surface is formed in a root of a fork, which is placed at the first end region of the compression spring element.

5. The apparatus for exercising muscles according to claim 4, wherein the cylindrical shafts are placed in two crosspieces opposite one another and disposed along the adjustment zone of the power arm.

6. The apparatus for exercising muscles according to claim 1, wherein the compression spring element is a gas pressure spring.

7. The apparatus for exercising muscles according to claim 1, wherein the first joint surface with the first curvature and the respective second joint surface with the second curvature are only led into one another.

8. The apparatus for exercising muscles according to claim 1, wherein the pull spring is an elastic band, and the second end of the pull spring is detachably attached to the power arm.

9. The apparatus for exercising muscles according to claim 1, wherein provided on the power arm along the adjustment zone is a scale.

10. Apparatus for exercising muscles according to claim 1, wherein the holding element is attachable to a supporting frame.

* * * * *